United States Patent [19]

Hackett

[11] 4,068,855

[45] Jan. 17, 1978

[54] GRAPHIC MERCHANDISING GONDOLA

[75] Inventor: Robert H. Hackett, Oakmont, Pa.

[73] Assignee: IDL Incorporated, Pittsburgh, Pa.

[21] Appl. No.: 692,345

[22] Filed: June 3, 1976

[51] Int. Cl.[2] ..... B62D 53/06

[52] U.S. Cl. ..... 280/79.3; 211/189

[58] Field of Search ..... 280/79.3, 79.2, 47.33, 280/47.24, 47.35; 211/189, 186, 57.1, 59.1; 248/221 A–221 G

[56] References Cited

U.S. PATENT DOCUMENTS

| | | | |
|---|---|---|---|
| 2,760,647 | 8/1956 | Saul | 280/79.3 |
| 2,963,173 | 12/1960 | Barnes | 211/189 |
| 3,149,727 | 9/1964 | Magers | 211/186 |
| 3,620,377 | 11/1971 | Holtz | 211/206 |

*Primary Examiner*—Robert R. Song

*Attorney, Agent, or Firm*—Parmelee, Miller, Welsh & Kratz

[57] ABSTRACT

A merchandising display gondola for floor mounting has been provided with an upright frame and at least one forwardly extending bottom support frame that has a lower, floor hugging, horizontal positioning. A pair of caster wheels are carried by a front end portion of the bottom frame, and a rounded, cross-extending, floor-engaging, tubular glide member is positioned adjacent a back end of the support frame. The glide member with the front casters positions the structure in a stable, supported position on the floor and enables an easy, manual gliding type of movement of the structure, when loaded or unloaded, from one position to another. The gondola is constructed of hollow, rounded tubular members of metal or reinforced plastic material for strength and weight saving purposes, and is provided with at least one pegboard panel, whereby numerous types of shelf, hook, article-carrying or positioning elements may be used. A colored masking design is applied to facing surfaces of the pegboard to screen its basic brownish or grayish drab, punchboard like appearance. The panels are removably mounted in order that the display may, from time to time, be adapted to show different pictorial representations.

22 Claims, 8 Drawing Figures

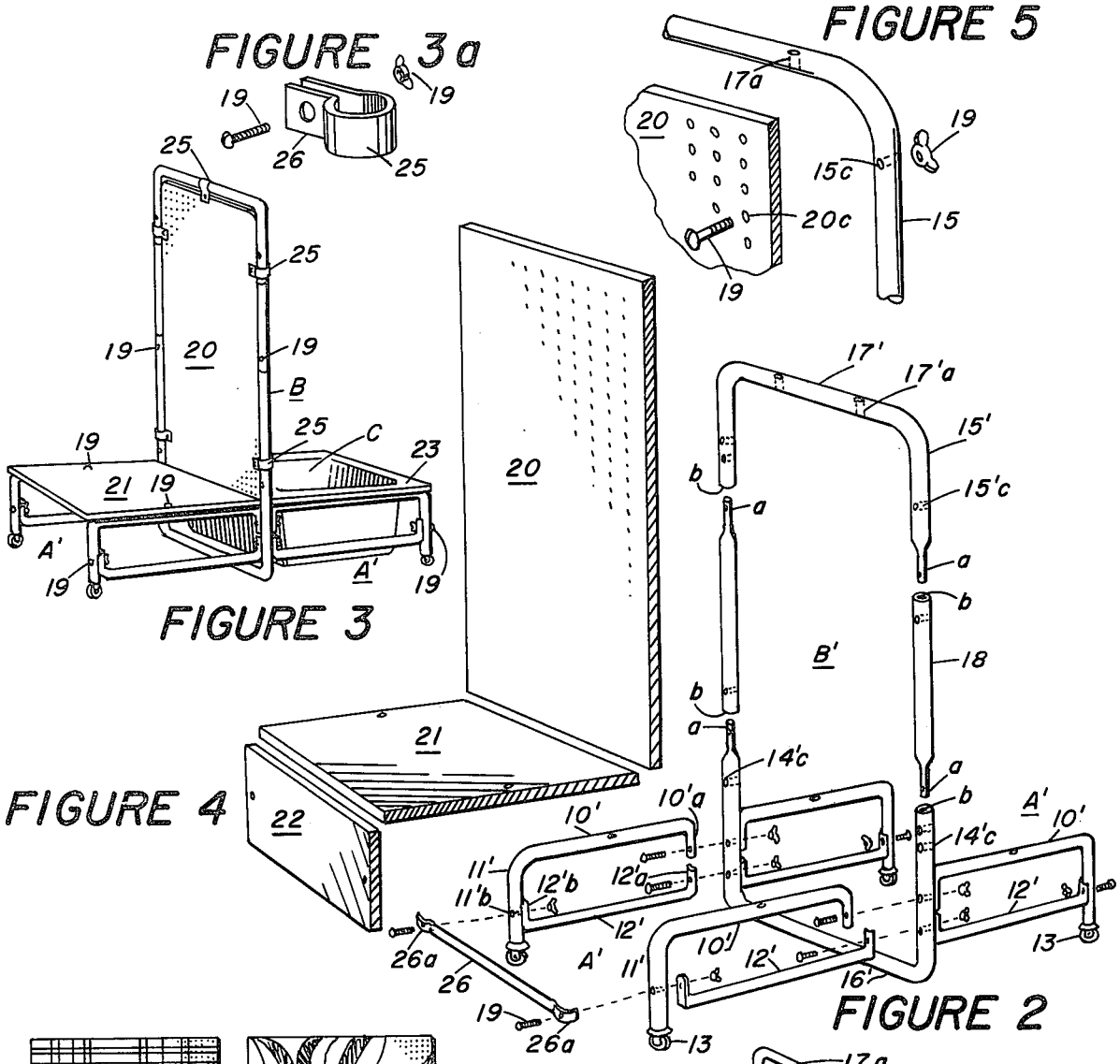
FIGURE 3a
FIGURE 5
FIGURE 3
FIGURE 4
FIGURE 2
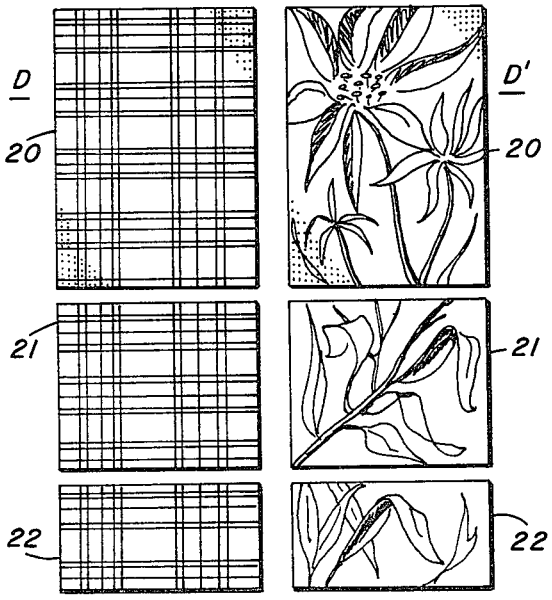
FIGURE 6
FIGURE 7
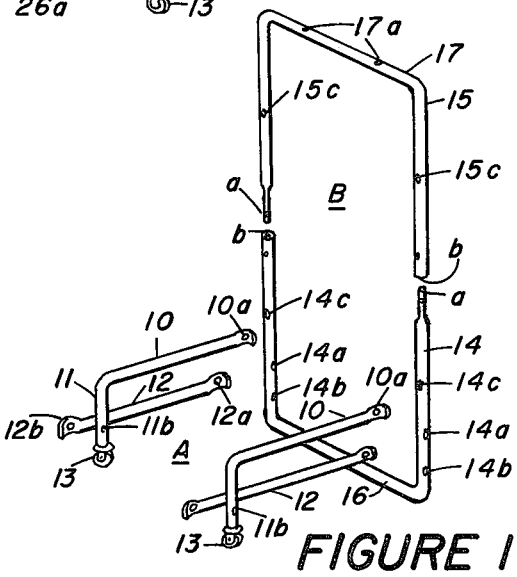
FIGURE 1

GRAPHIC MERCHANDISING GONDOLA

BACKGROUND OF THE INVENTION

1. Field of the Invention

This invention relates to a merchandising gondola for the display promotion of goods that will better facilitate its sales oriented utilization. A phase of the invention relates to an improved gondola of a type employed a pegboard which will have stability, an improved appearance, and which may be easily and uniquely moved from one floor-positioned location to another.

2. Description of the Prior Art

In recent years there has been a trend towards the use of so-called merchandising gondolas rather than of permanent, wall-mounted shelving for the purpose of displaying merchandise. It has been customary to provide a rather heavy bottom or projecting foot portion which may be used as a bottom display shelf and which may be enclosed to store goods in a non-displaying relation. Although such a gondola may have a semi-permanent form of shelving for merchandise, the approach has been towards a pegboard type of upright panel which will facilitate different arrangements of the goods and the display of different shapes and sizes of goods or articles.

One of the disadvantageous features of a so-called pegboard type of panel has been its rather drab, brownish or grayish natural appearance and particularly, even when painted, its punchboard appearance by reason of numerous holes that cover its surface but which, from a practical standpoint, are highly advantageous in adapting the display to various types of goods or articles. Gondolas may be of a so-called half or full type with the full type having a pair of oppositely extending, front and back, floor-positioned parts and with the half type having one forwardly projecting floor-positioned part.

Although conventional types of gondolas usually have a full surface-to-surface floor positioning, the need is for gondolas that will facilitate floor cleaning operations and movement to different display locations. The size of the units, the different types of floor surfaces encountered and the requirement for upright stability have heretofore tended to point to avoidance of the usage of floor casters or slides. Some units have, however, been provided with floor-engaging corner-mounted screw risers for leveling them with respect to uneven floor surfaces.

There has also been a need for a gondola whose pegboard panels have the perforations in their exposed surface faces effectively screened or masked to further appearance promotion of the goods on display. Such a construction should facilitate a change of masking appearance, the maintenance of positioning stability, and facilitate floorwise movement from one location to another.

SUMMARY OF THE INVENTION

It has thus been an object of the invention to devise a new form of gondola that will solve the problem presented by present day constructions.

Another object has been to devise a gondola that will facilitate the use of pegboard panels for enhancing rather than detracting from the display of goods, and which will enable alternate use of face surfaces of panels having different masking designs thereon to suit the particular needs of the product being sold.

A further object has been to devise a relatively inexpensive, lightweight gondola which although utilizing a pegboard panel will, in effect, mask its normal drab, holey, utilitarian appearance and provide an appropriate harmonizing design such that full display harmony and attraction may be better attained.

A still further object of the invention has been to devise a gondola constructed of lightweight tubular material which will have an upright stability, which will enable the removable utilization of pegboard-like display panels of different designs, and which will facilitate loaded as well as unloaded movement of the unit from one location to another on a display floor.

These and other objects of the invention will appear to those skilled in the art from the illustrated embodiments and the claims.

BRIEF DESCRIPTION OF THE DRAWINGS

FIG. 1 is an exploded isometric view in elevation illustrating half type of gondola frame assembly of the invention;

FIG. 2 is an exploded view on the scale of and similar to FIG. 1 showing a full or dual side type of gondola frame assembly of the invention; in this view a slightly modified type of frame construction is illustrated;

FIG. 3 is an isometric view in elevation of a full type of gondola having a dual-facing pegboard panel removably secured in position thereon; it also shows that a basket may be substituted for a base or shelf panel;

FIG. 3*a* is an exploded isometric view showing a representative clip for panels.

FIG. 4 is an isometric view illustrating an upright pegboard, and shelf and front apron panels that may be removably secured on the frames of FIGS. 1 and 2, as illustrated in FIGS. 3 and 5;

FIG. 5 is an enlarged fragmental isometric view in elevation showing means for removably securing a pegboard panel in position on the face of an upright part of the frame structure;

FIG. 6 is a plan view showing one type of masking design that may be applied to the panels of FIG. 4 for the purpose of screening the basic appearance of their facing surfaces and particularly, for providing a graphic representation that will effectively screen the basic appearance and the perforations or hole portions of a pegboard panel to the viewer; and FIG. 7 is a plan view on the scale of and similar to FIG. 6 illustrating a configurated form of design that may, for example, be applied to an opposite facing surface of the same upright pegboard panel and to associated shelf and skirt panels to enable a reversible utilization of two sets of designs from the standpoint of opposite viewing sides of a gondola.

DESCRIPTION OF THE PREFERRED EMBODIMENTS

In carrying out the invention, I have shown a gondola in FIG. 1 having a frame structure of interfitting hollow tubular members that are to be assembled into an integral unit. The unit employs a forwardly extending, floor-positioning, bottom support frame A of somewhat step-like construction, and a backwardly positioned, upright display frame B. The integral structure may be of any suitable material, such as aluminum or reinforced plastic, to provide both strength and lightness. The structure is such that stability is obtained although using a relatively light construction. Movement of the gondola from one position to another on the floor of a display room is thus facilitated. As shown, the frame may be of a half base type, as represented in FIG. 1, or of a full base or dual display type such as illustrated in FIGS. 2 and 3. In the full base type, bottom support frame A' (or A) is, in effect, duplicated by a similar, but oppositely extending bottom support frame A' which is shown mounted in the same manner and constructed in the same manner. Thus, the gondola may be constructed and used as either a single or a dual, two-sided merchandiser.

Again referring to FIG. 1, each frame A has a pair of spaced-apart, oppositely positioned, side frame parts which between them define a substantially rectangular, centrally open, horizontal area. Each side frame has a forwardly, horizontally extending upper arm or rail member 10 that, in effect, defines a step portion of the structure. Each upper rail member 10 has a downward, forwardly extending, front leg portion 11 that is open at its lower end to receivably mount and position an associated caster wheel 13 of a front pair. In this embodiment, each rail member 10 at its back end is bent-over and shaped to provide a mounting tab or foot 10*a* having a bolt-receiving hole. The foot 10*a* may be secured on an adjacent upright leg of a lower, U-shaped, upright frame part 14 by aligning its hole with an intermediate hole portion 14*a* of the leg and inserting a thumb nut and bolt assembly 19, such as illustrated in FIG. 5.

A lower reinforcing, forwardly extending, horizontal arm or rail member 12 of each side frame part of the bottom support frame A also has at its back end a mounting foot or lug 12*a* that is bent-over and provided with a through-extending hole for mounting in alignment with a lower hole portion 14*b* in an associated leg of the lower upright frame part 14. The mounting foot or lug 12*a* is also adapted to be removably secured in position by a bolt and nut assembly 19. The front end of each lower rail member 12 is provided with a similar type of mounting lug or foot portion 12*b* which is adapted to be aligned with a cross-extending hole 11*b* in the front leg 11 and also to be secured in position thereon by a nut and bolt assembly 19.

The upright support frame B in the embodiments of FIG. 1 comprises the lower U-shaped part 14 and an upper U-shaped part 15. It will be noted that the parts 14 and 15 are of substantially complementary construction and that their legs are alternately provided with reduced latching pin end portions *a* and cooperating mouth or socket end portions *b*. The support frame parts 14 and 15 may thus be assembled into a unitary rectangular frame, as shown in FIG. 3, by employing a frictional, telescopic assembling operation, using adjacent pin and socket end portions *a* and *b*. Also, if desired, they may be securely locked together by inserting nut and bolt assemblies 19 through their cooperating aligned hole portions.

Referring particularly to FIG. 2 of the drawings, a modified construction is shown which utilizes a pair of oppositely extending, horizontal, bottom support frames A'. Each frame A' has a pair of side frames that are made up of upper, horizontally extending rail or arm members 10', front leg portions 11', and lower, reinforcing and connecting bottom rail or arm portions 12'. As shown, each upper rail 10' has a downwardly bent, mounting foot portion 10'*a* whose hole is adapted to align with an associated hole in bottom support frame part 14' of the support frame assembly B'. Each lower arm or rail member 12' also has a mounting lug or foot 12'*a* that is bent vertically upwardly, and that is adapted to abut against a vertical leg of lower support frame part 14', with its hole portion aligned with an associated hole portion of the leg. In like manner, the front end of each bottom rail 12' has an upwardly turned foot or mounting tab portion 12'*b* whose hole is adapted to be aligned with a hole portion 11'*b* in the front leg 11' and to be secured thereto by a suitable nut and bolt assembly, such as 19.

If further reinforcement is desired, a front fender rail or arm 26 may be employed which has mounting portions 26*a* at its opposite ends that may also be aligned with the hole portions 11'*b*, and secured in position with the same nut and bolt assemblies 19 as secure the front feet 12'*b* of the bottom rails 12'. If a dual base unit is desired, then as indicated in FIG. 2, the rectangular-shaped side parts of each bottom frame A' may be secured to project in opposite directions from the bottom support frame part 14' by the same nut and bolt assemblies 19.

The upright frame B' of FIG. 2 is shown of a three-part, as distinguished from the two-part construction of the frame B of FIG. 1. However, the same idea of interfitting pin and socket portions *a* and *b* is employed, but extension rails 18 are inserted to provide additional length to the rectangular assembly. Also, the three parts 14', 15' and 18 may be secured together independently of their frictional interfitting relation by the use of bolt and nut assemblies 19.

In the embodiment of FIG. 1, hole portions 14*c* and 15*c* and, in the embodiment of FIG. 2, hole portions 14'*c* and 15'*c* may be used, as shown in FIG. 5, for securing a pegboard 20 in a removable relation on an upright rectangular frame B or B' as assembled. Also, in both embodiments, a bottom, horizontally extending rail 16, 16' serves as a stationary positioning rail, as well as a slide-glide rail for use during movement of the unit from one location to another. On the other hand, uppermost, cross-extending, horizontal rail 17, 17' serves as a hand rail and is shown provided with a pair of hole portions 17*a*, 17'*a* which may be used if it is desired to mount a head panel (not shown) thereon.

FIGS. 6 and 7 are illustrative of a cross-hatched pattern type of assembly D and of a configurated flower type of pattern assembly D', such as by painting or otherwise applying colored designs on an upright pegboard panel 20, a shelf or step panel 21 and an apron or skirt panel 22. These panels, as indicated by the mounted arrangement of FIG. 3, may be respectively mounted on the upright frame B or B' and on the lower frame A or A'. FIG. 3 indicates that the apron panel 22 may, if desired, be omitted. It also illustrates that one or both of the support frames A' may be employed to receive a basket, box or tray C. One of the support frames A' is shown as in FIG. 3 as having a basket C whose rectangular edges are defined by the continuous side flange 23. The side flange 23 is employed to enable the basket C to be supported on the upper rails 10' of and within the rectangular opening defined by the pair of side frame parts of the bottom support frame A' and preferably, in a slightly spaced relation off the floor level, as represented by the positioning of the bottom rail 16' and pair of casters 13. The use of a basket C enables the display of small miscellaneous articles that are, for example, specially priced for sale purposes.

FIG. 3 also shows another method of mounting a pegboard panel 20 which constitutes the main display panel on which the articles that are being merchandised will be suspended or carried. In this embodiment, the panel is held in position by U-shaped, spring clips 25, each of which has a pair of wings or lugs 26 through which bolt and nut assemblies 19 may extend. The type of panel mounting shown in FIG. 3 gives a maximum effect to a dual type of configuration, such that one pegboard panel 20 may be employed for display purposes on opposite sides of the unit. It is however, contemplated that a pair of pegboard panels 20 may be utilized in a back to back relation, as mounted on opposite sides on a support frame B or B' if the type of display, for example, requires a separate pegboard for supporting the merchandise to be viewed.

As indicated, the mounting of the various frame members, as well as the mounting of panels such as 20, 21 and 22 may be substantially fully accomplished by the use of nut and bolt assemblies 19. It will be noted that, if desired, the rim flange 23 of the basket C may also be provided with holes to enable it to be secured on arms 10' or 10 by assemblies 19. Preferably, a wing nut will be used to facilitate hand as distinguished from tool assembly and disassembly of the members. This, with the use of slidably interfitting sections for the upright, frames B, B', and the demountable construction of the members of the base support frame A, A' and with respect to the upright display frame B, B', enables a compact assembly of the members for storage and shipment purposes. It also facilitates a change-over from, for example, a dual type of construction such as illustrated in FIGS. 2 and 3 to a single type of gondola construction such as illustrated in FIG. 1, and vice versa.

As illustrated in FIGS. 6 and 7, different design variations may be employed to enhance the display, including graphic advertising material that is compatible with or that is descriptive of particular goods that are to be displayed. The design D of FIG. 6 consists of a pattern of different colored cross-extending lines of plaid-like appearance, which lines may run directly along the lines of the pegboard holes. The design D' of FIG. 7 is of colored, configurated flower type to emphasize the flowers and its leaves and de-emphasize and graphically screen or mask the multiplicity of holes in the panel.

An important feature of the invention independently of the masking, particularly of the holes and normally of the gray or brownish tinted pegboard 20, is involved in the fully demountable construction of the frame structure such that the frame structure, like the panels, may be packaged for flat storage and shipment, and easily assembled at the site of utilization.

If an auxiliary or head panel is used, it may also be of a pegboard type and provided with a perforation masking design and, preferably one which will conform with the outwardly facing design of panels, such as 20, 21 and 22. Although it has been determined that merely painting the surface of a pegboard panel appears to emphasize rather than mask or screen its perforations or holes, it has been discovered that appropriate colored designs as applied to a perforated pegboard surface will accomplish an effective screening or masking. The design serves to focus the attention of the viewer on its graphic representation. This desirable effect can also be enhanced by using a suitable selection of designs, such as D and D' shown in FIGS. 6 and 7.

Although FIGS. 6 and 7 show all the panels 20, 21 and 22 of a gondola as having the same general type of design, it will be appreciated that different combinations of designs may be used from the standpoint of the outwardly facing surfaces of an assembly of panels. It will further be apparent that infinite design variations may be employed to enhance the display, including graphic advertising material that is compatible with or that is descriptive of the particular goods that are being displayed.

Also, in solving the problem heretofore presented, a frame structure has been provided that is fully stable in its floor positioning and, at the same time, is readily movable from one location to another. This has been accomplished by the use of bottom frames A, A' whose front, down-turned legs 11 are provided with caster wheels 13 and used in combination with a backwardly positioned, cross-extending, rounded bottom member or rail 16 or 16' that has substantially the same plane of engagement as the casters with respect to the floor surface. In this connection, it is important to use a full cross-extending member 16 or 16' which is an integral part of the frame structure and has a rounded surface (in the direction of movement) to provide a gliding, slide type of movement. When a full or dual base supported type of structure, such as shown in FIGS. 2 and 3, is employed, the wheels 26 at the forward ends of the frames A', in combination with the glide rail member 16', provide it with a stationary as well as a moving stability in spite of the relatively extensive upright nature of its frame B' and the usual multiplicity of goods or articles which are suspended therefrom by the use of keys or elements that are adapted to fit within the pegboard holes therein.

In the type of frame structure such as shown in FIG. 1 having a single support frame A, stability has also been attained. Additional ease of movement may be effected by slightly easing the weight of the unit by gripping the side legs or the top rail 17' of the frame B while pushing or pulling the structure from one location to another. The construction minimizes friction and, at the same time, gives stability, not only in movement, but in stationary positioning, that enables a full use of a relatively lightweight, hollow tubular construction. When pushing or moving the unit from place to place, the weight or pressure is automatically placed on the casters 13. On high pile carpet, over extremely rough surfaces, or over a door sill that tend to retard caster movement, the bottom rail 16 of the embodiment of FIG. 1 enables a sliding-pulling movement after tilting the unit to ease or fully raise the casters 13 off the floor.

It should be emphasized that the provision of the design on the pegboard, as well as to other boards of the gondola, involves a direct printing or painting application such that the pegboard holes are not physically closed and are substantially incorporated in the design or format. This distinguishes from the use of a pasted-on printed sheeting, for example. The application may, as previously pointed out, be on one or both sides of the main or upright pegboard 20; it may be effected, for example, by the so-called screen printing process.

I claim:

1. In an improved merchandising gondola for mounting on a floor, a unitary frame structure of tubular construction having a horizontally extending floor-positioned bottom support frame of step-like construction and a backwardly positioned upright display frame, a cross-extending glide member in alignment with and connected to a lower end portion of said upright display frame and downwardly with respect to said bottom frame for engagement with the floor, and casters extending downwardly from said bottom frame in a forwardly spaced-apart relation with respect to said glide member for engaging the floor and with said glide member for retaining said frame structure in a stable easily moved position on the floor at which said upright frame is in a substantially straight vertically extending relation.

2. In an improved merchandising gondola as defined in claim 1, a pegboard panel removably secured on said upright frame, a colored masking design on a facing surface of said panel to screen its basic appearance including its hole portions and to project a graphic representation upon observers, said cross-extending glide member being of tubular shape and extending from a lower end of said upright frame adjacent a back end of said bottom frame, and said casters extending from front end portions of said bottom frame.

3. In an improved merchandising gondola as defined in claim 2, said display frame being composed of separate interfitting members that are removably secured together to provide a complete frame.

4. In an improved merchandising gondola as defined in claim 3, said support frame being composed of a pair of separate opposed side frames that are removably secured at their back ends to project forwardly from said display frame.

5. In an improved merchandising gondola as defined in claim 2, said bottom frame being defined by a pair of spaced-apart substantially continuous side frame parts each of which has a downwardly extending front leg portion, and said casters being carried by and extending downwardly from said front leg portions.

6. In an improved merchandising gondola as defined in claim 5, a secondary panel removably secured to and extending across between upper portions of said pair of side frame parts to cover the spacing therebetween, a tertiary panel removably secured to and extending across between said front leg portions, and a colored masking design on facing surfaces of said secondary and tertiary panels.

7. In an improved merchandising gondola as defined in claim 6, a basket having an upper outwardly extending rim flange, and said basket being adapted to fit downwardly within the spacing between said pair of side frame parts with its said rim flange resting on said side frame parts.

8. In an improved merchandising gondola as defined in claim 5, each of said side frame parts being removably secured at its back end to said upright display frame and projecting forwardly therefrom to define a central open area therebetween, said display frame having a pair of U-shaped tubular members, and the ends of each of said U-shaped members having alternate socket and pin interfitting portions for assembling said members into a unitary frame.

9. In an improved merchandisng gondola as defined in claim 8, a second bottom support frame of the same defined construction as said first-mentioned bottom support frame, and said second bottom support frame extending in an opposite direction with respect to said first-mentioned frame and from said upright display frame.

10. In an improved merchandising gondola as defined in claim 9, means removably securing back end portions of said first and second bottom support frames to project in opposite directions from said upright display frame.

11. In an improved merchandising gondola as defined in claim 2, said bottom frame having a pair of horizontally spaced-apart side frame parts defining a substantially rectangular centrally open area therebetween, a secondary panel removably secured on upper portions of said pair of side frame parts to close-off said open area, and a colored masking design on the upper surface of said secondary panel to screen its basic appearance and project a graphic representation upon observers.

12. In an improved floor-positioned merchandising gondola for mounting a pegboard panel, a skeleton-like integral frame structure of demountable tubular construction having a vertically extending upright display frame for carrying the panel and also having opposed pairs of forwardly extending horizontal side rail portions and a pair of downwardly extending front leg portions in a spaced-apart relation defining a bottom support frame of step-like construction, a transverse horizontally extending rounded positioning member mounted on said frame structure in a downwardly offset relation with respect to a back end portion of said bottom support frame to provide a slidable engagement with the floor, and each said front leg portion having a downwardly extending caster wheel mounted thereon for engaging the floor on substantially the same plane as said positioning member and cooperating therewith for supporting said frame structure in a stable upright position and enabling easy manual movement of said structure along the floor.

13. In an improved merchandising gondola as defined in claim 12, said upright display frame being of rectangular shape and having at least a pair of parts removably secured together in a telescopic interfitting relation, and said positioning member being a lower cross-connecting member of a lower one of said pair of parts.

14. In an improved merchandising gondola as defined in claim 12, the side rails of each side of said bottom support frame defining a vertical rectangular-shaped side frame part that is removably secured at its back end to a lower end portion of said upright frame, and said side rails of each said side frame part being removably secured together.

15. In an improved merchandising gondola as defined in claim 12, at least one pegboard panel removably secured on said upright display frame with its opposite surfaces facing towards opposite sides of said frame, and a colored masking of different design on opposite facing surfaces of said panel to screen its basic appearance including its hole portions and project a graphic representation upon observers, said panel being adapted to provide a selection of front facing designs by removing it from said upright frame and reversing its forward facing surface.

16. In an improved merchandising gondola as defined in claim 15, a panel having a colored masking design thereon removably secured on said horizontal side rail portions of said bottom frame to extend horizontally across therebetween, and a panel having a colored masking design removably secured on said front leg portions of said bottom support frame to extend vertically across therebetween.

17. In an improved floor-positioned merchandising gondola for mounting a pegboard panel for display purposes, an integral frame structure of tubular construction having a substantially planar vertically positioned upright display frame of substantially rectangular shape and at least one bottom support frame demountably extending horizontally outwardly from said upright display frame, said upright display frame having a cross-connecting horizontal member of rounded shape at its lower end adapted to engage the floor and serve as a supporting glide member, said glide member extending below a back end portion of said bottom support frame to position said frame at its back end in an upwardly spaced relation with respect to the floor, a pair of downwardly extending side-positioned tubular members carried forwardly of said bottom support frame, a pair of casters mounted in lower end portions of said pair of side-positioned tubular members to engage the floor below said bottom support frame and position an outer end portion of said frame in a spaced relation above the floor that is substantially the same as the spaced relation of its back end portion as provided by said glide member, and said glide member and pair of casters being adapted to position said upright display frame in a substantially straight vertical plane and said bottom support frame in a substantially horizontally extending plane, at least one substantially planar primary pegboard panel for said upright display frame, a substantially planar secondary board-like panel for said bottom support frame, means removably securing said primary panel in an upright supported relation on said upright display frame, means for removably securing said secondary panel on and over an upper side of said bottom frame, and colored masking designs on exposed faces of said primary and secondary panels to screen their basic appearance including hole portions of said pegboard panel and to project the designs upon observers.

18. In an improved merchandising gondola as defined in claim 17, said primary panel having a different design on its opposite wide side faces and being adapted for interchangeable usage from the standpoint of its opposite wide side faces as secured on said upright display frame.

19. In an improved merchandising gondola as defined in claim 18, a second bottom support frame of the same defined construction as said first-mentioned bottom support frame, said second bottom support frame being demountably secured at its back end on said upright display frame to extend forwardly from a side thereof that is directly opposite with respect to the side from which said first-mentioned bottom support frame extends, and a second pair of casters mounted in lower end portions of the side-positioned tubular members carried forwardly of said second bottom support frame to engage the floor below said second bottom support frame and position it in a spaced relation thereabove.

20. In an improved merchandising gondola as defined in claim 17, said upright display frame being defined by a pair of upper and lower cross-extending tubular portions and a pair of side-positioned vertically extending spaced-apart endwise-connected tubular portions, said lower tubular portion being said glide member, said bottom support frame being defined by horizontally spaced-apart side pairs of tubular members extending horizontally forwardly from associated vertical members of said upright frame, each of said side pairs of tubular members of said lower support frame being of vertical rectangular shape, and said side pairs being retained in a horizontally spaced-apart relation with respect to each other by said side-positioned vertically extending tubular members of said upright display frame.

21. In an improved merchandising gondola as defined in claim 20, said upright display frame comprising a group of tubular parts having end-connecting interfitting socket and pin portions, bolt and nut assemblies adapted to removably secure said interfitting portions together, and bolt and nut assemblies demountably securing said bottom support frame on said upper display frame.

22. In an improved merchandising gondola for mounting and moving along a floor, a unitary frame structure of tubular construction having a horizontally extending floor-positioned bottom support frame of step-like construction and a backwardly positioned upright display frame, a cross-extending glide member mounted on said frame structure in a downwardly offset relation with respect to an end portion of said bottom frame to provide a slidable engagement with the floor, said bottom frame having a pair of downwardly extending legs in a spaced relation at an opposite end portion thereof, and caster wheels mounted on said legs for engaging the floor on substantially the same plane as said glide member and cooperating therewith for retaining said frame structure in a stable easily moved upright position on the floor.

* * * * *